US006335498B1

(12) United States Patent
James et al.

(10) Patent No.: US 6,335,498 B1
(45) Date of Patent: Jan. 1, 2002

(54) SHOCK SENSOR EMPLOYING A SPRING COIL FOR SELF-TEST

(75) Inventors: Philip James; Martyn John Bensley, both of Norwich (GB)

(73) Assignee: Bread Automotive Technology, Inc., Lakeland, FL (US)

( * ) Notice: Subject to any disclaimer, the term of this patent is extended or adjusted under 35 U.S.C. 154(b) by 0 days.

(21) Appl. No.: 09/860,908

(22) Filed: May 18, 2001

(51) Int. Cl.[7] ..... H01H 35/14

(52) U.S. Cl. ..... 200/61.45; 200/61.53; 335/205

(58) Field of Search ..... 73/514.16, 514.21, 73/514.31; 200/61.45 R–61.45 M; 335/205–207

(56) References Cited

U.S. PATENT DOCUMENTS 4,980,526 A * 12/1990 Reneau ..... 200/61.45 M
4,987,276 A * 1/1991 Bader et al. ..... 200/61.45 M
5,212,357 A * 5/1993 Reneau ..... 200/61.45 M
5,326,945 A * 7/1994 Gotoh et al. ..... 200/64.45 R
5,416,293 A * 5/1995 Reneau ..... 200/61.45 M
5,440,084 A * 8/1995 Fuse et al. ..... 200/61.45 R
5,770,792 A * 6/1998 Nakada et al. ..... 73/12.01

* cited by examiner

*Primary Examiner*—Michael Friedhofer
(74) *Attorney, Agent, or Firm*—Lonnie Drayer; Patrick Stiennon

(57) ABSTRACT

A reed switch based shock sensor provides for passing electrical current through the coil spring used to bias the shock sensing magnetic mass. The spring is wrapped around the reed switch, allowing the coil spring to act as an electrical coil. The coil generates a magnetic field of sufficient strength to cause the reed switch reeds to attract and so close the reed switch, thus allowing the reed switch to be tested without the addition of a test coil.

12 Claims, 2 Drawing Sheets

SHOCK SENSOR EMPLOYING A SPRING COIL FOR SELF-TEST

FIELD OF THE INVENTION

The present invention relates to shock sensors incorporating a reed switch in general, and to shock sensors incorporating self-testing in particular.

BACKGROUND OF THE INVENTION

A typical automobile manufactured today has a number of active safety systems that function to deploy air bags, and initiate seatbelt retractors and other devices. As the cost of air bags decreases, and the sophistication of air bags increases, the number of air bags provided in each vehicle is increasing. Systems now being installed or under development include multiple air bags to protect the passenger from front, rear, and side impacts, and to position the passenger's body to withstand acceleration. Deployment of safety systems requires sensors that can detect and characterize a crash as it occurs. The widespread use of safety systems results in ever increasing attention to producing systems that can be economically employed on a large number of vehicles.

Typically, the lowest cost sensors are those formed as micro devices on an integrated circuit chip used to form electronic circuitry. This technology is used to fabricate accelerometers that can detect accelerations indicative of a vehicle crash. These sensors are particularly cost effective when the sensor can be fabricated together with the deployment logic circuitry using the same technology which is used cost effectively for large scale integrated circuit chips. However, the very small size of these devices makes them sensitive to electromagnetic interference and the like, which can result in false indications that a crash is taking place.

Thus an important role remains for macro scale mechanical devices which are less prone to false readings. Such devices are used to verify the existence of an actual crash event. These macro scale devices employ a sensing mass mounted on a spring or pendulum. Motion of the mass is detected by actuation of a reed switch or a magnetic field sensor.

The typical reed switch shock sensor employs a magnet, a spring, and a reed switch mounted in a housing. The three components are arranged so that under an acceleration-induced load the magnet acting as an acceleration sensing mass compresses the spring and moves to a position where the magnetic field of the magnet causes the reeds of the reed switch to attract and thus close the reed switch.

The reed switch shock sensor is a highly reliable component. However, many electronic circuits today incorporate built-in test, and the reed switch is indistinguishable from an open circuit unless the circuit board is undergoing the proper acceleration. Thus, in some cases the shock sensor may incorporate some method of self-testing which can verify the presence of the reed switch and which may cause the reed switch to operate. Such self-testing functions typically require additional parts, including the addition of a self-test electrical coil to cause the reed switch to close.

What is needed is a shock sensor employing a reed switch that can be self-tested without the addition of a test coil.

SUMMARY OF THE INVENTION

The reed switch based shock sensor of this invention provides means for passing electrical current through the spring used to bias the shock sensing magnetic mass in the unactuated position. The spring extends between a first stop and a shock sensing magnetic mass that is biased against a second stop. So long as the magnetic mass is held against the second stop, the reed switch remains open. A path for electrical current is created which leads through the coil spring used to bias the sensing mass. The coil spring is wrapped around the reed switch, allowing the coil spring to act as an electrical coil. The electric coil generates a magnetic field of sufficient strength to cause the reed switch reeds to attract and so close the reed switch, thus allowing the reed switch to be tested, without the addition of an electrical test coil.

It is a feature of the present invention to provide a shock sensor that facilitates built-in test.

It is a further feature of the present invention to provide a shock sensor having a reed switch that can be electrically detected.

It is another feature of the present invention to provide a shock sensor that can be actuated electronically for a self-test, without the addition of a test coil.

Further features and advantages of the invention will be apparent from the following detailed description when taken in conjunction with the accompanying drawings.

DETAILED DESCRIPTION OF THE INVENTION

Figure 1:
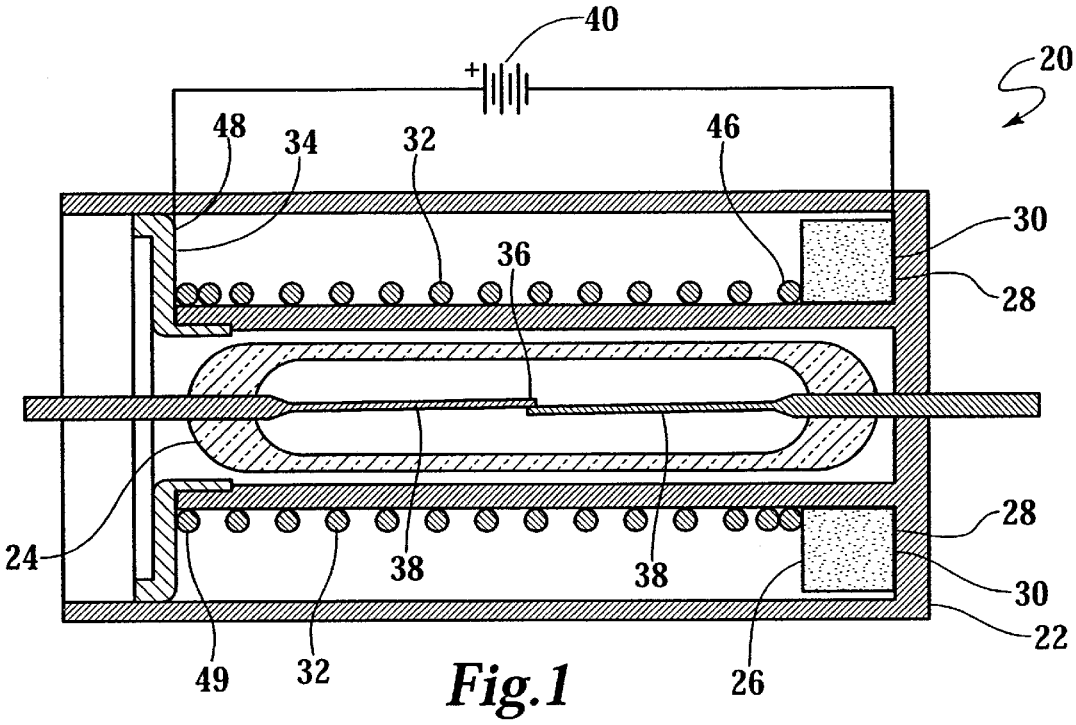
FIG. 1 is a cross-sectional view of the shock sensor of this invention.

Referring more particularly to FIGS. 1–4 wherein like numbers refer to similar parts, a shock sensor 20 is shown in FIG. 1. The shock sensor 20 has a housing 22. A reed switch 24 is mounted on the housing 22, and a shock sensing magnet 26 is positioned for movement on the housing. The shock sensing magnet 26 is in the shape of a ring which is positioned coaxially about the reed switch 24. A spring 32 biases a shock sensing magnet 26 against a first stop 28 formed by portions 30 of the housing 22. The spring 32 extends between the magnet 26 and a second stop 34 spaced from the first stop 28 and spaced axially along the reed switch 24.

When the shock sensor 20 undergoes acceleration due to a crash event, the magnet 26 compresses the spring 32 until the magnet moves to a second position adjacent the overlapping portions 36 of the reed switch reeds 38. Properly positioned, the magnet will cause the reeds to take on opposite magnetic polarities and so attract to close the switch formed by the reed switch 24.

It is generally not practical or desirable to test a reed switch shock sensor by subjecting it to shock levels simulative of a crash event. It is known in the prior art to place an electrical coil around the reed switch so that when the coil is energized the reed switch closes. It is also known to use an electric coil to cause the shock sensing magnet 26 to move so as to close the reed switch 24. Such prior art solutions require the addition of an electrical coil, resulting in some increase in cost, size and part count. The shock sensor of this invention 20 is arranged to pass a current through the spring 32 which is used to bias the shock sensing magnet against the first stop 28. A typical coil used to actuate a reed switch will employ a coil having thousands to tens of thousands of turns, and operation of the reed switch by energizing the coil will typically require a power of a small fraction of one Watt.

Through experimentation it has been shown that coil springs having, for example, between 26 and 33 turns, can support sufficient current to cause actuation of a reed switch in a shock sensor configuration. Table 1 provides test results for two coil springs: part number 251-90-226-00 which has 26 coils and a resistance of 7.3 ohms; and part number 251-90-084-00 which has 27 coils and a resistance of 10.8 ohms. Each coil was positioned about a series of reed switches (Hamlin type MLRR-4) with different ampere turn requirements, as shown in column one of Table 1, the reed switch having ampere turn requirements of 14, 15, 16 and 23 ampere turns.

TABLE 1

| Coil Spring | 251-90-226-00 | Theoretical AT | 251-90-084-00 | Theoretical AT |
|---|---|---|---|---|
| Coil Turns | 26 | | 27 | |
| Resistance (Ω) | 7.3 | | 10.8 | |
| Switch AT | Volts | | Volts | |
| 14 | 3.90 | 13.89 | 7.10 | 17.75 |
| 15 | 4.25 | 15.14 | 7.57 | 18.93 |
| 16 | 4.48 | 15.96 | 8.50 | 21.25 |
| 23 | 8.20 | 29.21 | 14.10 | 35.25 |
| 24 | | | | |
| 25 | | | | |
| 29 | | | | |

TABLE 2

| Coil Spring | 251-90-018-00 | Theoretical AT | 251-90-071-00 | Theoretical AT |
|---|---|---|---|---|
| Coil Turns | 29 | | 33 | |
| Resistance (Ω) | 6.9 | | 10.6 | |
| Switch AT | Volts | | Volts | |
| 14 | 1.72 | 7.23 | 5.40 | 16.81 |
| 15 | 2.94 | 12.36 | 5.90 | 18.37 |
| 16 | 3.85 | 16.18 | 6.40 | 19.92 |
| 23 | 6.20 | 26.06 | 10.80 | 33.62 |
| 24 | 7.63 | 32.07 | | |
| 25 | 7.92 | 33.29 | | |
| 29 | 10.30 | 43.29 | | |

Voltage across the coil spring was increased until the switch closed and the voltage at which the switch closed was recorded. The number of ampere turns (Theoretical AT) required was calculated by taking the voltage value at switch pull in, dividing that value by the resistance of the spring to get a value for the current and finally multiplying the value of the current by the number of turns on the spring.

Similarly, in Table 2, coil spring part No. 251-90-018-00 having 29 coil turns and resistance of 6.9 ohms, and part number 251-90-071-00 having 33 coil turns and resistance of 10.6 ohms were tested with switches having ampere turn requirements between 14 and as high as 29. Again the number of ampere turns (Theoretical AT) required was calculated by taking the voltage value at switch pull in, dividing that value by the resistance of the spring to get a value for the current and finally multiplying the value of the current by the number of turns on the spring.

Voltage values for switches with higher ampere turn requirements are not entered in the tables where the high voltages caused warping of the springs. Generally, a burning smell was noticed around 5–6 volts when the voltage was left on for around 25 seconds. Therefore it is concluded that reed switches should be used which are sensitive enough to respond to the ampere turns which can be achieved with four volts.

Looking at the power dissipated, it is evident that 4 Volts corresponds to about two Watts of dissipated power. As evidenced by the Theoretical AT becoming substantially greater than the Switch AT at the higher voltages, the resistance of the coil is increasing due to the increased coil temperature. If greater ampere turn values are required in any shock sensor which utilizes the coil spring as a test coil, increasing the number of turns in the coil and/or decreasing the resistance of the coil will be necessary to avoid excessive power dissipation with the attendant undesirable heating of the coil spring.

Figure 3:
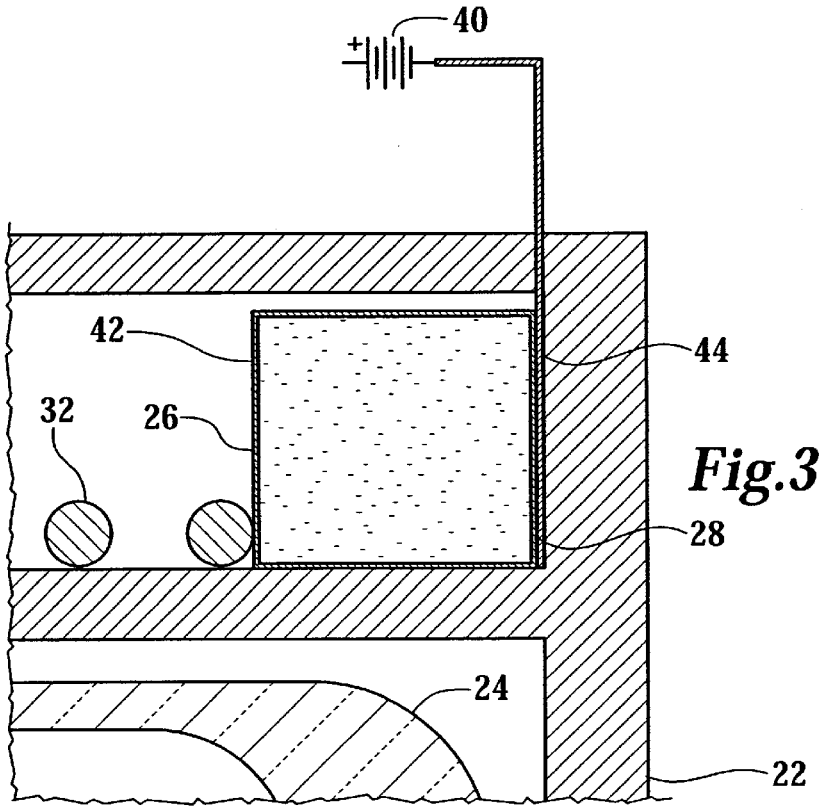
FIG. 3 in an enlarged detail view of the electrical connection between the housing and the spring of FIG. 1.

Referring to FIGS. 1 and 3, it is illustrated how an electrical voltage source 40 can be connected across the spring 32, which extends between the magnet 26 and a portion of the housing forming a second stop 34. Referring particularly to FIG. 3, the magnet 26 is shown plated with a conductive material 42 such as copper or silver so that current can readily flow between a contact 44 attached to the portion of the housing 30 forming the first stop 28 and a first end 46 of the spring 32. Similarly a contact 48 is formed on the second stop 34 completing the electrical circuit from the electrical voltage source 40 to the second end 49 of the spring 32. Although movement of the magnet 26 breaks the electrical connection between the spring and the contact 44, this occurs only during crash induced acceleration.

Figure 2:
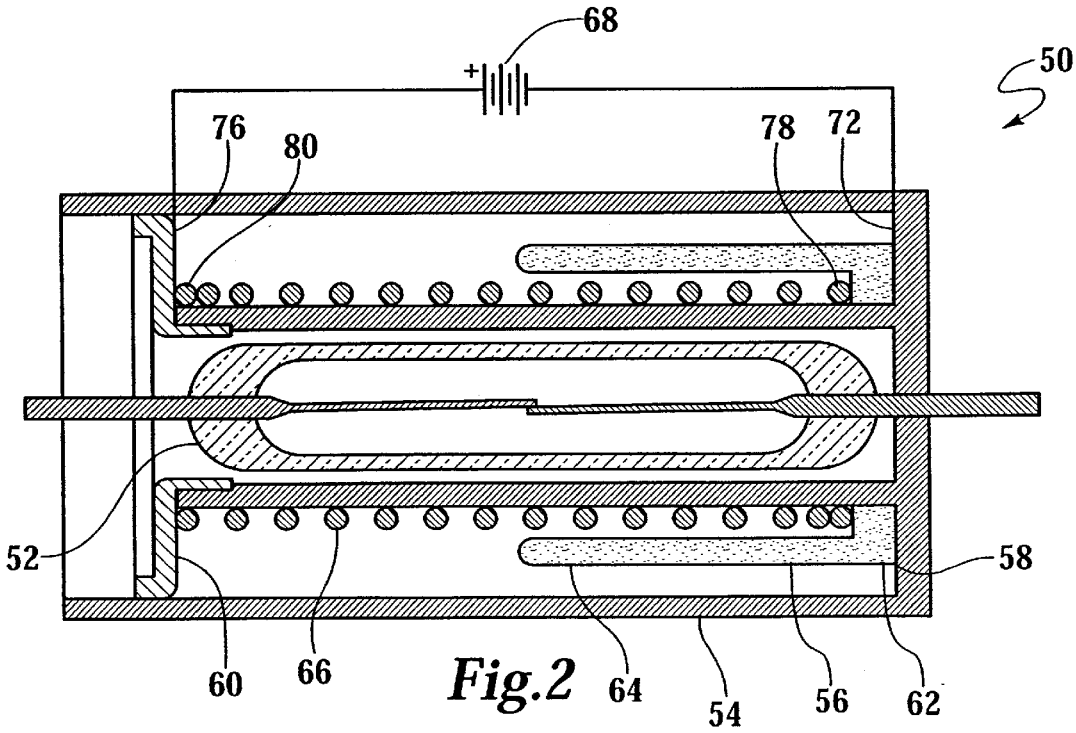
FIG. 2 is a cross-sectional view of an alternative embodiment of the shock sensor of FIG. 1.
Figure 4:
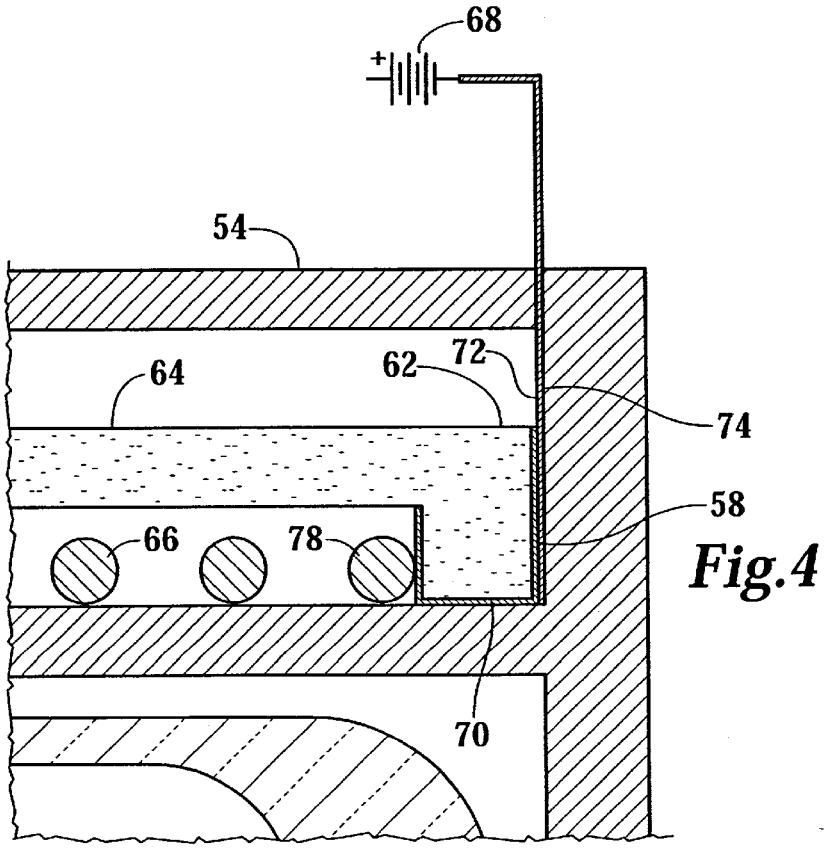
FIG. 4 in an enlarged detail view of the electrical connection between the housing and the spring of FIG. 2.

Referring to FIGS. 2 and 4, an alternative embodiment shock sensor 50 is shown in FIG. 2. The shock sensor 50 employs a reed switch 52 mounted on a housing 54. A magnet 56 is movable on the housing and is positioned coaxially about the reed switch 52. This shock sensor 50 has the overall configuration of the shock sensor shown in U.S. Pat. No. 5,212,357 to Reneau which is incorporated herein by reference. The housing 54 has a first stop 58 and a second stop 60 spaced a fixed distance from the first stop 58.

The activation magnet 56, being slidably mounted on the housing 54, has a first portion 62 engaged against the first stop 58 and a second portion 64 which engages against the second stop. The magnet first portion 62 has a greater magnetic flux than the second portion 64. The reed switch 52 is responsive to the position of the activation magnet 56 such that the reed switch is activated when the magnet travels to a preselected activation position during movement of the magnet in response to acceleration applied to the sensor. A coil spring 66 biases the magnet 56 such that the first portion 62 engages against the first stop 58, and the coil spring 66 extends between the magnet 56 and the second stop 60.

FIG. 3 shows how a voltage source 68 is connected across the spring 66 by an electrically conducting portion 70 of the magnet, which abuts a contact 72 fixed to the portion of the housing 74 forming the first stop 58. A first end 78 of the spring 66 is thus in electrical engagement with the magnet 56. The electrical circuit is completed by a second contact 76 affixed to the second stop 60 which engages a second end 80 of the spring 66.

It should be understood that the magnet could be conducting or other means for applying electrical current to the coil spring could be employed.

It should be understood that the coil spring through which the current passes must be positioned so as to result in a magnetic field that causes the reeds of the switch to attract, thus closing the reed switch.

It should be understood that the number of ampere turns required to activate a given reed switch is dependent on the detail configuration of the coil, and so the rated ampere turns is to some extent a relative measurement.

It is understood that the invention is not limited to the particular construction and arrangement of parts herein illustrated and described, but embraces such modified forms thereof as come within the scope of the following claims.

What is claimed:

1. A shock sensor of the type comprising:

a housing having a first stop and a second stop spaced from the first stop;

a shock sensing magnetic mass slidably mounted on the housing and having a first portion engaged against the first stop when the housing is not undergoing acceleration;

a reed switch mounted to the housing to be responsive to the position of the shock sensing magnetic mass such that the reed switch is activated when the shock sensing magnetic mass travels to an activation position during movement of the shock sensing magnetic mass in response to an acceleration force applied to the sensor;

a coil spring extending between a first end which is engaged with the shock sensing mass, and a second end which is engaged with the second stop, the coil spring wrapped coaxially about the reed switch, the spring biasing the shock sensing magnetic mass by extending between the second stop and the shock sensing magnetic mass biasing the magnetic mass against the first stop, a preselected level of acceleration causing the magnetic mass to slide on the housing to activate the reed switch;

wherein the improvement comprises: a voltage source connected across the first end, and the second end of the coil spring, so as to cause a current to flow therethrough which is sufficient to cause the reed switch to close.

2. The shock sensor of claim 1 wherein the voltage source supplies a voltage of less than about four volts.

3. The shock sensor of claim 1 further comprising:

a first electrical connection mounted to the housing and positioned on the first stop;

a second electrical connection mounted on the housing and positioned on the second stop, wherein the second end of the coil spring is engaged with the second electrical connection, and wherein the shock sensing magnetic mass forms an electrical connection between the first electrical connection and the first end of the coil spring.

4. The shock sensor of claim 3 wherein a portion of the shock sensing magnetic mass is covered with a conductive material which extends between the first stop and the first end of the coil spring.

5. A shock sensor comprising:

a housing having a first stop and a second stop;

an activation magnet mounted for movement on the housing between the second stop and the first stop;

a reed switch mounted to the housing and coaxial with the activation magnet such that the reed switch is activated when the magnet travels to an activation position in response to an acceleration force applied to the sensor;

a coil spring wrapped coaxially about the reed switch, the spring biasing the magnet such that the spring extends between the first stop and the activation magnet to bias the activation magnet against the second stop, so that the reed switch remains unactivated until the housing is subjected to the acceleration force, the acceleration causing the magnet to slide on the housing to the activation position to activate the reed switch;

a first electrical connection mounted to the housing and positioned on the first stop; and a second electrical connection mounted on the housing and positioned on the second stop, wherein the coil spring is engaged with the second electrical connection, and wherein the shock sensing magnetic mass forms an electrical connection between the first electrical connection and the coil spring.

6. The shock sensor of claim 1 wherein a voltage is connected between the first electrical connection and the second electrical connection.

7. The shock sensor of claim 6 wherein the voltage source supplies a voltage of less than about four volts.

8. The shock sensor of claim 6 wherein a portion of the shock sensing magnetic mass is covered with a conductive material which extends between the first stop and the first end of the coil spring.

9. A shock sensor comprising:

a housing;

a shock sensing magnet mass slidably mounted on the housing;

a reed switch mounted to the housing to be responsive to the position of the shock sensing magnetic mass;

a coil spring extending between the shock sensing magnetic mass and the housing and forming a coil about the reed switch;

a voltage source connected across the coil spring, so as to cause a current to flow therethrough which is sufficient to cause the reed switch to close.

10. The shock sensor of claim 9 wherein the voltage source supplies a voltage of less than about four volts.

11. The shock sensor of claim 9 further comprising:

a first electrical connection mounted to the housing and positioned on a first stop;

a second electrical connection mounted on the housing and positioned on a second stop, wherein the coil spring is engaged with the second electrical connection, and wherein the shock sensing magnetic mass forms an electrical connection between the first electrical connection and the coil spring, and the voltage source is connected to the first electrical connection and the second electrical connection.

12. The shock sensor of claim 11 wherein a portion of the shock sensing magnetic mass is covered with a conductive material which extends between the first stop and the coil spring.

* * * * *